US008262136B2

(12) United States Patent
Lundgren

(10) Patent No.: US 8,262,136 B2
(45) Date of Patent: Sep. 11, 2012

(54) HOLDING MEANS FOR A HYDRAULIC COUPLING

(75) Inventor: Bertil Lundgren, Bjärtrå (SE)

(73) Assignee: Nordhydraulic AB, Kramfors (SE)

( * ) Notice: Subject to any disclaimer, the term of this patent is extended or adjusted under 35 U.S.C. 154(b) by 485 days.

(21) Appl. No.: 12/516,869

(22) PCT Filed: Nov. 16, 2007

(86) PCT No.: PCT/SE2007/050860

§ 371 (c)(1),
(2), (4) Date: May 29, 2009

(87) PCT Pub. No.: WO2008/066478

PCT Pub. Date: Jun. 5, 2008

(65) Prior Publication Data

US 2010/0001144 A1 Jan. 7, 2010

(30) Foreign Application Priority Data

Dec. 1, 2006 (SE) ..... 0602577

(51) Int. Cl.
*F16L 11/12* (2006.01)

(52) U.S. Cl. ..... 285/45; 285/124.2; 285/901; 248/75

(58) Field of Classification Search ..... 285/124.1, 285/124.2, 124.3, 124.4, 401, 402, 45, 62, 285/63, 901; 172/273, 813; 414/723; 248/75; 37/468

See application file for complete search history.

(56) References Cited

U.S. PATENT DOCUMENTS

| | | | | | |
|---|---|---|---|---|---|
| 2,788,991 | A | * | 4/1957 | Neuhauser | 285/124.1 |
| 3,527,480 | A | * | 9/1970 | Larson | 285/124.1 |
| 4,366,965 | A | * | 1/1983 | Rhodes | 248/75 |
| 4,395,800 | A | * | 8/1983 | Shindelaar | 248/75 |
| 4,483,371 | A | * | 11/1984 | Susin | 138/89 |
| 5,082,217 | A | * | 1/1992 | Parker et al. | 248/75 |
| 5,316,347 | A | | 5/1994 | Arosio | |
| 5,333,400 | A | * | 8/1994 | Sonerud | 414/723 |
| 5,417,459 | A | * | 5/1995 | Gray et al. | 285/124.1 |
| 5,507,530 | A | * | 4/1996 | Mahaney | 285/124.1 |
| 5,660,408 | A | * | 8/1997 | Johnson | 248/75 |
| 5,829,337 | A | * | 11/1998 | Barden | 285/26 |

(Continued)

FOREIGN PATENT DOCUMENTS

JP 8049253 2/1996

(Continued)

*Primary Examiner* — David E Bochna
(74) *Attorney, Agent, or Firm* — Stites & Harbison PLLC; Marvin Petry

(57) ABSTRACT

A holding device to protect a movable connector part of a hydraulic system on work equipment, which mates with a fixed connector part of a hydraulic system on a work vehicle. The holding device is fixedly mounted on the work equipment and has recesses which receive and protect the hydraulic connections of the movable connector part when they are not engaged with the fixed connector part. The holding device may have a contact surface which mates with the hydraulic connectors of the movable part. The recess or recesses can receive a multipart hydraulic connector or a plurality of individual connectors. The holding device may include an electrical connector dummy for attachment to an electrical connector on the work equipment. A cover fits over the holding device when it is not engaged by a movable connector part; and it also mates with the fixed connector part when it is not engaged by the movable connector part.

7 Claims, 3 Drawing Sheets

U.S. PATENT DOCUMENTS

| | | | | |
|---|---|---|---|---|
| 5,984,371 | A * | 11/1999 | Mailleux | 285/26 |
| 5,988,569 | A * | 11/1999 | Zhang et al. | 248/65 |
| 5,988,697 | A * | 11/1999 | Arosio | 285/124.1 |
| 6,017,065 | A * | 1/2000 | Hellesøe | 285/124.2 |
| 6,443,498 | B1 * | 9/2002 | Liao | 285/124.1 |
| 6,543,563 | B1 * | 4/2003 | Muraro | 180/89.12 |
| 6,622,646 | B1 * | 9/2003 | Bennett et al. | 248/75 |
| 6,776,421 | B2 * | 8/2004 | Arrand et al. | 285/124.3 |
| 6,860,290 | B2 * | 3/2005 | Knuthson | 285/124.1 |
| 6,899,509 | B1 | 5/2005 | Mailleux | |
| 7,021,668 | B2 * | 4/2006 | Langenfeld et al. | 285/124.1 |
| 7,083,202 | B2 * | 8/2006 | Eberle et al. | 285/124.4 |
| 7,258,369 | B2 * | 8/2007 | Martin | 285/124.4 |
| 7,464,967 | B2 * | 12/2008 | Mieger et al. | 285/124.1 |
| 7,686,563 | B2 * | 3/2010 | Frey et al. | 414/723 |
| 7,703,812 | B2 * | 4/2010 | Asam et al. | 285/124.3 |
| 7,717,471 | B2 * | 5/2010 | Langenfeld et al. | 285/124.1 |
| 8,007,010 | B2 * | 8/2011 | Langenfeld et al. | 285/124.1 |

FOREIGN PATENT DOCUMENTS

| | | |
|---|---|---|
| JP | 2007195447 | 8/2007 |

* cited by examiner

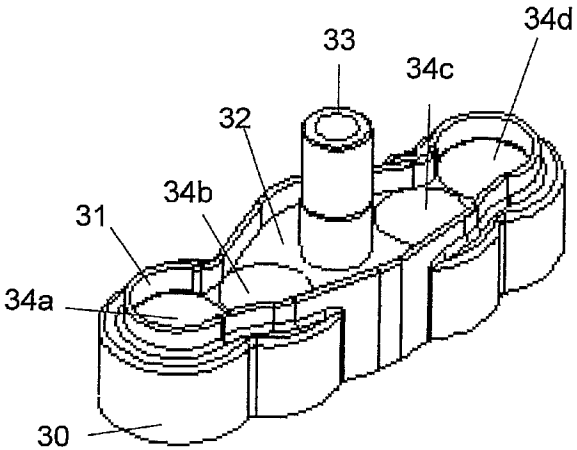
Fig. 6
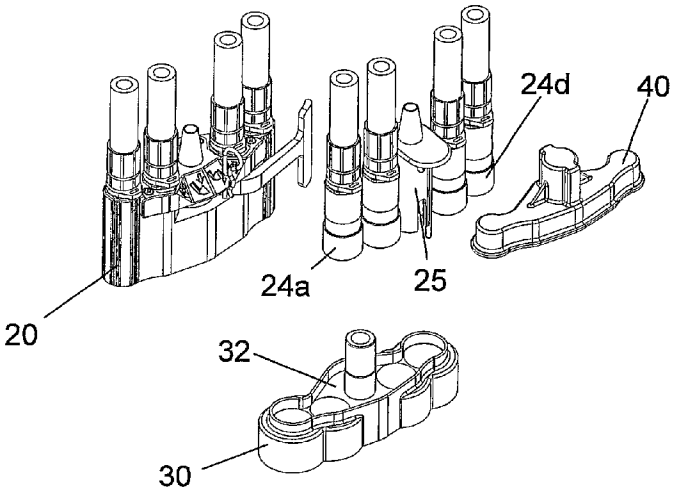
Fig. 7
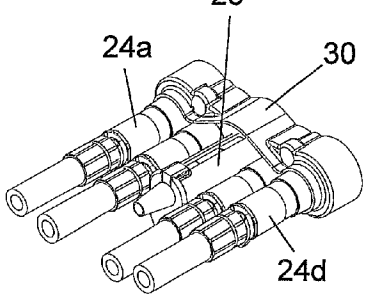
Fig. 8
Fig. 9
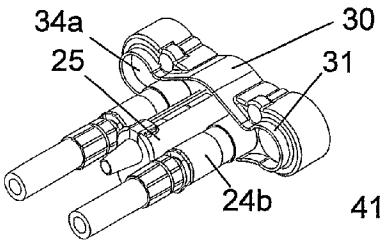
Fig. 10
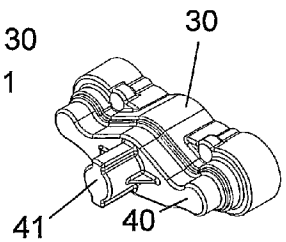
Fig. 11

HOLDING MEANS FOR A HYDRAULIC COUPLING

TECHNICAL AREA

The present invention relates to a holding means for holding and protecting a movable connector part of a hydraulic system.

BACKGROUND OF THE INVENTION

Hydraulic systems are used in a wide variety of applications. One application relates to work vehicles, such as wheel loaders or tractors, to which a work equipment, such as front loader, a plough, a bucket or similar, my be connected. A part from being mechanically connected to the work vehicle, the work equipment also needs to be hydraulically connected. The work equipment includes a hydraulic system for controlling its functions. This hydraulic system is connected to and driven by the hydraulic system of the work vehicle.

The two hydraulic systems are interconnected by means of connector parts. The connectors are preferably of a multi coupling type, in which a plurality of hydraulic connections may be connected in one single operation. A multi coupling comprises a fixed part on the vehicle and a movable part on the work equipment. It is however still common to connect each and every hydraulic connection individually, usually by means of so called quick couplings, one for every connection. In this application a "fixed connector part" denotes the connector on the work vehicle regardless of if it is of a multi coupling type or of comprises a plurality of individual couplings. Accordingly, application a "movable connector part" denotes the connector on the work equipment regardless of if it is of a multi coupling type or if it comprises a plurality of individual couplings.

It is important for the well function of these connectors that they are kept clean, both during working operations, but also in between working operations. The work vehicle often operates in harsh environments, in which the connector parts are exposed to dirt. Thus, there exists a need for an arrangement for protecting the connector parts of the hydraulic systems. As the work vehicle sometimes is operated without work equipment the protective arrangement needs to adaptable, such that it also protects the fixed connector part and the movable connector part individually when they are disconnected from each other.

Conventionally, the fixed connector part has been provided with a pivotable lid, which is arranged to cover the fixed connector part when no movable connector part is connected to it. To connect the movable connector part, the cover is folded open to make room for the movable connector part. This conventional type of cover protects the fixed connector part satisfactory when it is left disconnected. However, other than that it has a number of disadvantages. Firstly, the cover collects dirt during operation as the lower protective surface of it is left exposed to the environment during normal operation. Thus the cover has to be cleaned each time it is to be remounted on the fixed connector part. Additionally, no protection is provided for the movable connector part when it is disconnected from the fixed connector part. Normally, the work equipment with the exposed movable connector part is stored in a rather dirty environment, often outside. Thus it is not uncommon that the movable connector part needs to be cleaned before it is connected to the fixed connector part.

BRIEF DESCRIPTION OF THE INVENTION

An aim of the present invention is to provide an improved arrangement for keeping the connector parts clean.

This is achieved according to the present invention by the holding means of claim 1. Preferable embodiments of the present invention are indicated in the dependent claims.

According to a main aspect, the invention relates to a holding means for protecting a movable connector part of a hydraulic system on a work equipment, which movable connector part is connectable to a fixed connector part of a hydraulic system on a work vehicle, the holding means having an contact surface being adapted to fit tightly on the movable connector part such that its hydraulic connections are protected and unexposed when the movable connector part is placed in the holding means. The holding means is adapted to be fixedly arranged on a work equipment, such that the contact surface of the holding means is accessible for protective connection of the movable connector part.

An advantage of the present invention is that the movable connector part is kept clean in between operations, such that it does not have to be cleaned before use.

Further, a second advantage of the invention is that thanks to the holding means the movable connector part of the work equipment is protected from impact as long as it is parked in the holding means. In prior art where there was no provision for protecting the movable connector part when disconnected from the fixed connector part there was always a risk that it might be damaged in one way or another. This risk is clearly minimised with the holding means according to the invention.

SHORT DESCRIPTION OF THE DRAWINGS

In the following detailed description of the invention, reference will be made to the accompanying drawings, of which:

FIG. 6 shows the holding means in detail;

FIG. 7 shows the holding means and three sets of connectable fittings;

FIG. 8 shows the movable connector part parked in the holding means;

FIG. 9 shows a movable connector part in form of 4 individual hydraulic couplings and an electric connector parked in the holding means;

FIG. 10 shows a movable connector part in form of 2 individual hydraulic couplings and an electric connector parked in the holding means;

FIG. 11 shows a cover arranged on the holding means.

DETAILED DESCRIPTION OF THE INVENTION

Figure 1:
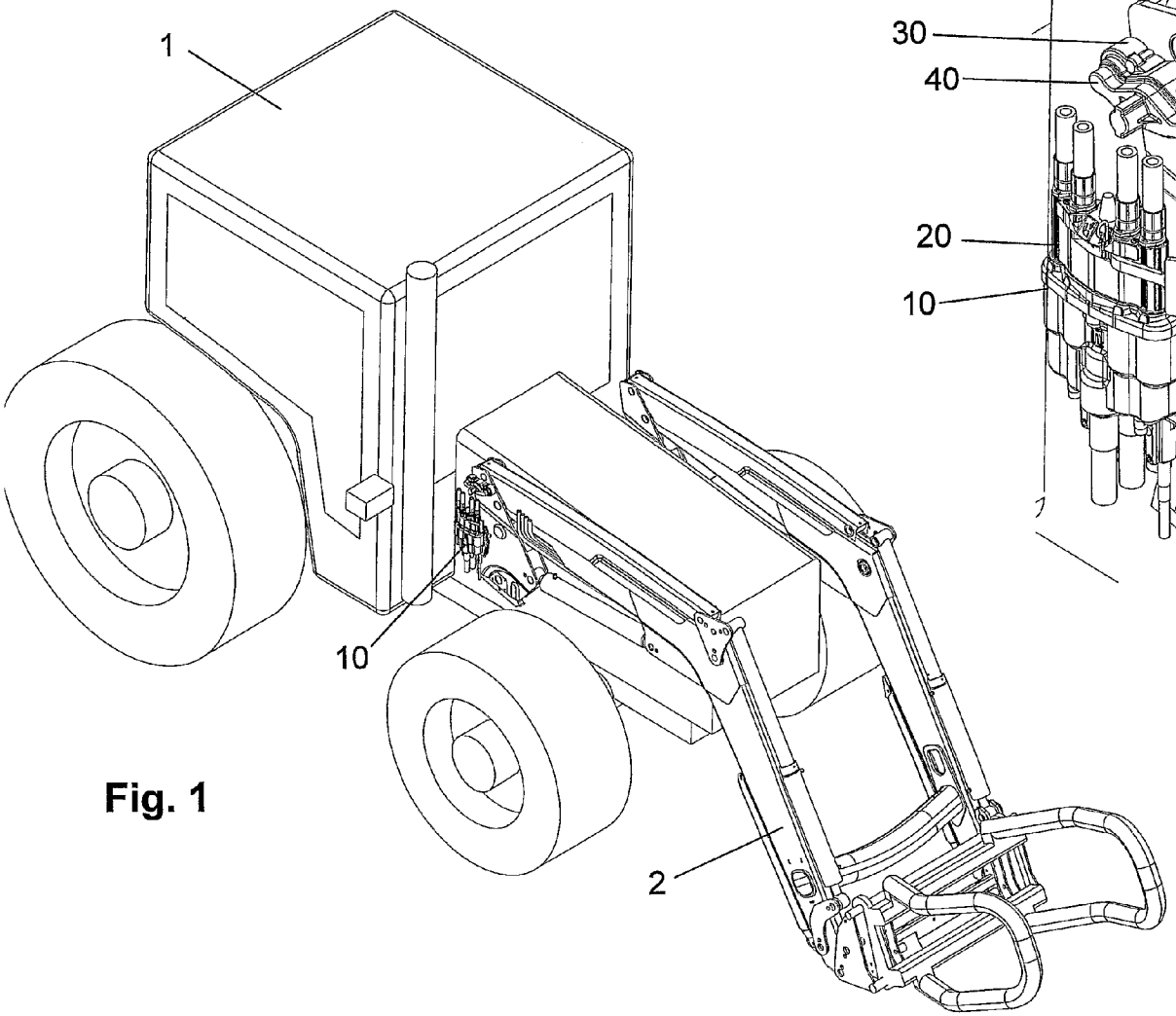
FIG. 1 shows a work vehicle provided with a fixed connector part, wherein a work equipment with a movable multi coupling part is arranged on the work vehicle.

FIG. 1 shows a schematic view of a work vehicle 1, i.e. a tractor, provided with a conventional hydraulic system comprising a hydraulic pump, a tank with hydraulic fluid and a number of conduits, connections and valves. The hydraulic system comprises a fixed connector part 10, which is adapted to be connected to a movable connector part of a hydraulic system of a work equipment 2 to be used on the work vehicle 1. In FIGS. 1-5 the movable connector part is represented by a movable multi coupling part 20.

Often, a work vehicle 1 is used for a number of different work tasks involving different work equipments 2. In the figures, the work equipment 2 is exemplified by a front loader unit, which is releasably attached to the work vehicle 1. In addition to the movable connector part 20, the front loader is provided with a movable hydraulic system comprising connections, conduits and pistons for lifting the loader and tilting the bucket. Generally, different types of equipments are adapted to be releasably attached to the work vehicle 1. Hence, the hydraulic connection unit of the work equipments 2, i.e. the movable connector part, must be adapted to be connected to/disconnected from the fixed connector part 10 of the hydraulic system on the work vehicle 1. Additionally, different tools may be connected to the work equipment 2. The tools generally also include hydraulic systems, which systems need to be connected to the hydraulic system of the work vehicle, via the hydraulic system of the work equipment 2. These connections might or might not be of the same type as the connections between the work equipment 2 and the work vehicle 1. For the sake of simplicity, only the connection between the work equipment 2 and the work vehicle 1 is described in this application. The invention may however also be used at the connection between the work equipment 2 and the tool.

Figure 2:
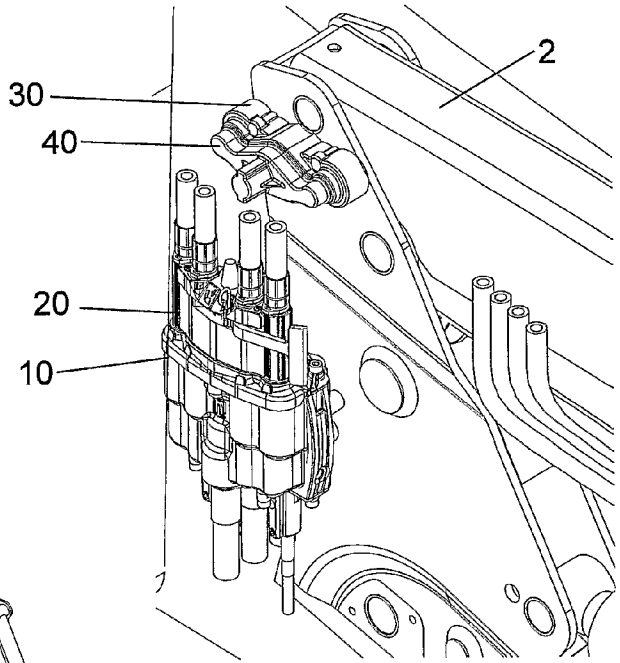
FIG. 2 shows a detailed view of the fixed connector part of FIG. 1.

FIGS. 1-2 show the work vehicle 1 when the work equipment 2 is arranged on it. In this state, the movable multi coupling part 20 is connected to the fixed connector part 10, and a cover 40 is arranged to protect a holding means 30, which is arranged on the work equipment 2.

Figure 4:
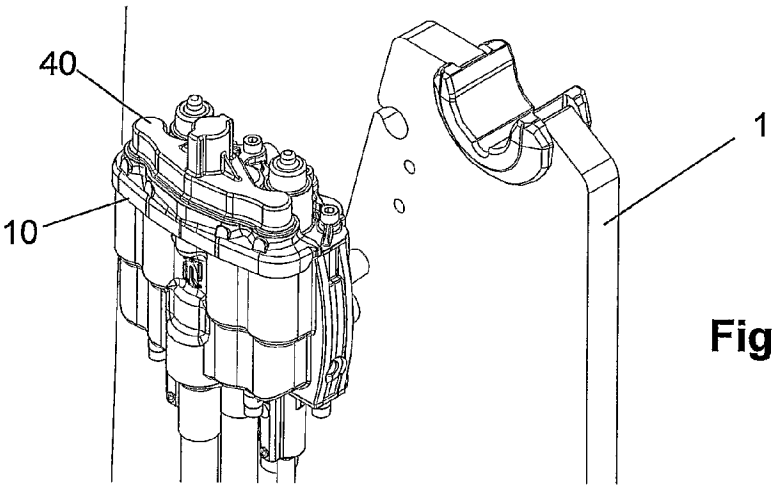
FIG. 4 shows a detailed view of the fixed connector part of FIG. 3 provided with a cover according to an embodiment of the invention.
Figure 5:
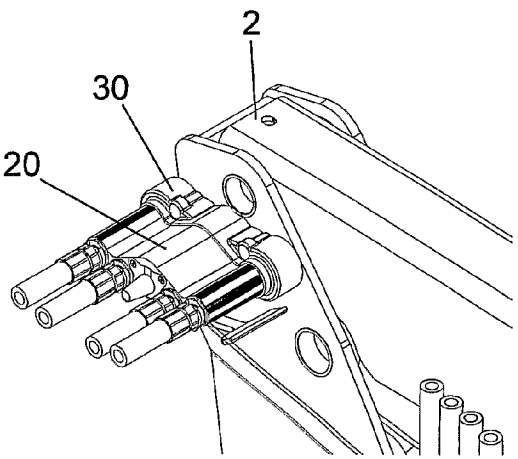
FIG. 5 shows a detailed view of the movable connector part of FIG. 3, parked in a holding means according to the invention.
Figure 3:
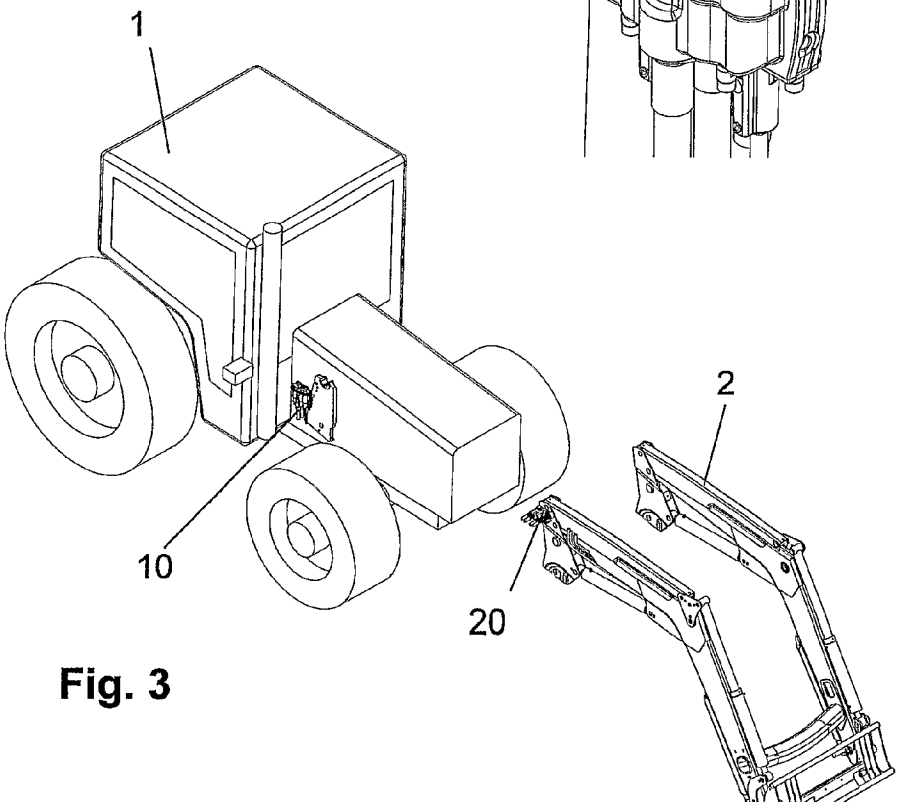
FIG. 3 shows a work vehicle with a disconnected work equipment.

In FIGS. 3-5, the work equipment 2 is disconnected from the work vehicle 1. In this state the movable multi coupling part 20 is parked in the holding means 30, and the cover 40 is instead arranged on the fixed connector part 10 in order to protect it.

The main aspect of the invention concerns the holding means 30 or "parking slot", which is adapted to be arranged on the work equipment 2 on a suitable location where it does not interfere with the function of the work equipment. The holding means 30 is designed such that it mates with the movable multi coupling part 20. Thus, it resembles the fixed connector part 10 and comprises an contact surface 32 arranged to correspond to and co-act with the connection surface of the movable multi coupling part 20, in order to protect the connection surface of the movable multi coupling part when attached to the holding means 30. The holding means 30 in the shown embodiment is provided with a central bar 33 corresponding to a bar of the embodied fixed hydraulic connection part 10. The holding means 30 is further provided with a circumferential rim 31, inside which the movable multi coupling part 20 fits tightly, such that it is efficiently held at place without any possibility to rotate. Preferably, the rim 31 also defines the outer border of the contact surface 32. Thus, the rim functions as a protective limit, keeping dirt away from the contact surface.

When the work equipment 2 is not to be used any more, the movable multi coupling part 20 is disconnected from the fixed connector part 10 on the work vehicle and inserted into the holding means 30 in which it fits tightly and remains fixed. The movable multi coupling part 20 is thus kept out of the way and is at the same time protected from the environment, such that dirt, debris, ice, snow etc. is kept away from its connection surface. Conventionally the connection part of the work equipments have been left exposed to the environment, which of course may lead to all kinds of problems, including total failure of the connector part due to impact with neighbouring objects, and heavy soiling of both the connector part and the environment due to spillage of hydraulic fluid.

As indicated above, not all work equipments 2 are provided with a movable connector part of a multi coupling type. Therefore, the holding means 30 according to the invention is also adapted to receiving conventional hydraulic quick couplings. Openings 34*a-d* are arranged in the holding means 30, which are dimensioned to house individual quick couplings 24*a-d*, see e.g. FIG. 9 or 10. Hence, if the work equipment 2 is furnished with individual quick couplings 24*a-d* instead of a movable multi coupling part 20, these may be individually housed in these openings 34*a-d* of the holding means 30. Often, en electric connection is integrated in the fixed connector part for supplying the work equipment with electricity. Therefore, the holding means is provided with a dummy 33 arranged for attachment of such an electric connection of the work equipment.

In the shown embodiment the electric connection is covered by a housing 25 which fits on the central dummy 33.

Consequently, a holding means 30 is advantageously arranged on all work equipments 2 that include a hydraulic system, regardless of the type of connection the hydraulic system of the work equipment 2 is provided with.

A second protecting means, in form of a cover 40, is provided in accordance with the present invention on the one hand for protecting the fixed connector part 10 when the movable connector 20, 24*a-d* part is not connected to it, and on the other for protecting the holding means 30 when the movable connector part is connected to the fixed connector part 10. The cover 40 is arranged as a lid with a lower surface that corresponds to the lower surface of the movable connector part 20, such that it fits the upper surface of the fixed connector part 10 and the upper surface of the holding means 30. The cover 40 may further be arranged with a central sleeve which protrudes through an opening in the cover, and is connected to a knob 41 for turning the sleeve around its longitudinal axis. The sleeve may have the same configuration as the sleeve of the movable connector part 20, which enables the sleeve to be attached to the central bar 13 of the fixed connector part 10 in order to protect the hydraulic connections of the fixed connector part 10 when it is not in use. On the other hand, when the hydraulic system of the equipment is connected to the hydraulic system of the work vehicle, the cover is attached to the holding means 30 in order to protect the holding means 30 from dirt and debris. Thus, the holding means 30 and the cover 40 provides a full protection of the hydraulic connection parts of the present invention both during use and when parked.

As the cover is intended to be transferred between the fixed connector part and the holding means it may not fixed to either of these. However it may preferably be attached to the work vehicle by means of a strap or similar. This is conceivable as the cover 40 is only attached to the holding means 30 when the work equipment with the holding means is attached to the work vehicle 1. When the work equipment 2 is disconnected from the work vehicle 1 the movable connector part 20 is placed in the holding means 30 and the cover 40 is placed on the fixed connector part 10. It is of course possible within the scope of the claims to use two individual covers, one for the fixed connector part 10 and for the holding means 30, but for such an embodiment the covers need to be arranged such that they do not collect dirt when they are disconnected.

In the shown embodiment the holding means and the cover are designed to fit a special embodiment of a movable and a fixed connector part, respectively. As can be readily understood from the above the present invention may however be designed in many ways without departing from the scope of protection as defined by the patent claims. A general idea is that the holding means and the cover should be designed to fit the movable and the fixed connector part of the hydraulic system where it is to be implemented. It is thereby to be understood that the embodiments described above and shown in the drawings are to be regarded as non-limiting examples.

The invention claimed is:

1. A holding device for protecting a movable connector part of a hydraulic system on work equipment, the movable connector part having hydraulic connections which mate with a fixed connector part of a hydraulic system on a work vehicle, the holding device being fixedly mounted on the work equipment and having a recess or recesses therein which receive and protect the hydraulic connections of the movable connector part when they are not engaged with the fixed connector part, the holding device being free of any hydraulic connections, and including a cover member which is shaped to mate with and cover the holding device when the holding device is not being engaged by the connector part, and wherein the cover also mates with the fixed connector part when the fixed connector part is not engaged with the movable connector part.

2. A holding device according to claim 1, wherein the holding device has a contact surface which mates with the hydraulic connections of the movable connector part, such that said hydraulic connections are protected and unexposed when placed into the holding device.

3. A holding device according to claim 1, wherein the recess or recesses of the holding device are constructed to receive a multipart hydraulic connection or a plurality of individual hydraulic connections.

4. A holding device according to claim 1, wherein the recess or recesses of the holding device include a contact surface, and wherein said recess or recesses and the contact surface are constructed to receive a multipart hydraulic connection or a plurality of individual hydraulic connections.

5. A holding device according to claim 1, wherein the holding device includes an electrical connector dummy arranged to be attached to an electrical connector of the work equipment.

6. A holding device according to claim 1, wherein the recess or recesses includes a circumferential rim constructed to hold the hydraulic connections of the movable connector part tightly therein.

7. A holding device according to claim 6, wherein the recess or recesses include a contact surface, and the said rim extends outwardly from said contact surface.

* * * * *